US010685760B2

(12) United States Patent
Zhang et al.

(10) Patent No.: US 10,685,760 B2
(45) Date of Patent: Jun. 16, 2020

(54) ULTRA-CONDUCTIVE WIRES AND METHODS OF FORMING THEREOF

(71) Applicant: General Cable Technologies Corporation, Highland Heights, KY (US)

(72) Inventors: Shenjia Zhang, Zionsville, IN (US); Sathish Kumar Ranganathan, Avon, IN (US)

(73) Assignee: GENERAL CABLE TECHNOLOGIES CORPORATION, Highland Heights, KY (US)

( * ) Notice: Subject to any disclaimer, the term of this patent is extended or adjusted under 35 U.S.C. 154(b) by 0 days.

(21) Appl. No.: 16/421,020

(22) Filed: May 23, 2019

(65) Prior Publication Data

US 2019/0362864 A1 Nov. 28, 2019

Related U.S. Application Data

(60) Provisional application No. 62/676,610, filed on May 25, 2018.

(51) Int. Cl.
*H01B 1/02* (2006.01)
*H01B 13/00* (2006.01)

(52) U.S. Cl.
CPC ..... *H01B 1/026* (2013.01); *H01B 13/0016* (2013.01); *H01B 13/0036* (2013.01); *H01B 13/0026* (2013.01)

(58) Field of Classification Search
CPC ..... B02C 7/16; B21C 1/003; B21C 37/047; B21C 37/045; B22D 17/04; B22D 17/14; B22D 19/02; B22D 27/15; B22F 3/14; B22F 3/20; B22F 5/12; B22F 9/18; B22F 9/30; B82Y 30/00; C01B 32/16; C01B 32/172; C22C 1/101; C22C 1/1015; C22C 1/1036; C22C 1/0425; C22C 1/1084; C22C 47/12; C22F 1/08; H01B 1/04; H01B 13/0016; H01B 13/0036; H01B 13/0026; H01B 13/00
USPC ..... 174/126.1; 164/61, 98; 241/27; 977/752
See application file for complete search history.

(56) References Cited

U.S. PATENT DOCUMENTS

| | | | | |
|---|---|---|---|---|
| 3,323,882 | A * | 6/1967 | Albert | H01B 1/02 428/611 |
| 2009/0008779 | A1* | 1/2009 | Suhir | H01L 23/373 257/751 |
| 2012/0077017 | A1* | 3/2012 | Buresch | C23C 4/129 428/312.8 |
| 2012/0152480 | A1* | 6/2012 | Nayfeh | B82Y 30/00 164/61 |
| 2016/0168693 | A1 | 6/2016 | Schmidt et al. | |
| 2016/0368035 | A1 | 12/2016 | Kobayashi | |
| 2018/0102197 | A1 | 4/2018 | Adams | |
| 2018/0339492 | A1* | 11/2018 | Aytug | C01B 32/172 |

FOREIGN PATENT DOCUMENTS

| | | | | |
|---|---|---|---|---|
| CN | 107245590 | A | 10/2017 | |
| FR | 3016727 | A1 * | 7/2015 | B22F 3/20 |
| WO | 2018064137 | A1 | 4/2018 | |

OTHER PUBLICATIONS

Charvet, Pierre; Extended European search report including the European search report and the European search opinion issued in European Patent Application No. 19176465.3; dated Oct. 29, 2019; 8 pages.

* cited by examiner

*Primary Examiner* — Timothy J Thompson
*Assistant Examiner* — Guillermo J Egoavil
(74) *Attorney, Agent, or Firm* — Ulmer & Berne LLP

(57) ABSTRACT

Ultra-conductive wires having enhanced electrical conductivity are disclosed. The conductivity of an ultra-conductive wire is enhanced using cold wire drawing and annealing. Methods of making the ultra-conductive wires are further disclosed.

11 Claims, No Drawings

ULTRA-CONDUCTIVE WIRES AND METHODS OF FORMING THEREOF

CROSS-REFERENCE TO RELATED APPLICATIONS

The present application claims the priority of U.S. Provisional Patent Application Ser. No. 62/676,610, entitled ULTRA-CONDUCTIVE WIRES AND METHODS OF FORMING THEREOF, filed May 25, 2018, and hereby incorporates the same application herein by reference in its entirety.

TECHNICAL FIELD

The present disclosure generally relates to ultra-conductive wires.

BACKGROUND

Ultra-conductive metals refer to alloys or composites which exhibit greater electrical conductivity than the pure metal from which the ultra-conductive metal is formed. Ultra-conductive metals are produced through the incorporation of certain, highly conductive, additives into a pure metal to form an alloy or composite with improved electrical conductivity. For example, ultra-conductive copper can be formed through the incorporation of highly conductive nano-carbon particles, such as carbon nanotubes and/or graphene, into high purity copper. Known ultra-conductive metals have required the inclusion of large quantities of such highly conductive additives to significantly boost the electrical conductivity of the pure metal.

PCT Patent App. Pub. No. WO 2018/064137 describes a method of forming a metal-graphene composite including coating metal components (10) with graphene (14) to form graphene-coated metal components, combining a plurality of the graphene-coated metal components to form a precursor workpiece (26), and working the precursor workpiece (26) into a bulk form (30) to form the metal-graphene composite. A metal-graphene composite includes graphene (14) in a metal matrix wherein the graphene (14) is single-atomic layer or multi-layer graphene (14) distributed throughout the metal matrix and primarily (but not exclusively) oriented with a plane horizontal to an axial direction of the metal-graphene composite.

U.S. Patent App. Pub. No. US 2016/0168693 A1 describes a method of tailoring an amount of graphene in an electrically conductive structure, includes arranging a substrate material in a plurality of strands and arranging at least one graphene layer coated circumferentially on one or more of the strands of the plurality of strands, the graphene layer being a single atom-thick layer of carbon atoms arranged in a hexagonal pattern, the substrate material and the at least one graphene layer having an axial direction. A first cross-section taken along the axial direction of the substrate and the at least one graphene layer includes a plurality of layers of the substrate material and at least one internal layer of the graphene alternatively disposed between the plurality of layers of the substrate material.

SUMMARY

In accordance with one embodiment, a method of making an ultra-conductive wire having enhanced conductivity includes cold wire drawing a pre-wire product formed from an ultra-conductive metal to form a drawn wire and annealing the drawn wire to form an ultra-conductive wire. The ultra-conductive metal is formed from a pure metal and a nano-carbon additive. The pure metal is copper. The ultra-conductive wire exhibits an International Annealed Copper Standard ("IACS") conductivity of 100% or greater.

DETAILED DESCRIPTION

In contrast to conventional metal alloys which exhibit decreased electrical conductivity as the purity of the metal drops, ultra-conductive metals, such as ultra-conductive coppers, exhibit greater conductivity than the pure metal through the incorporation of nano-carbon additives. For example, ultra-conductive copper can exhibit an International Annealed Copper Standard ("IACS") conductivity of greater than 100% despite the decreased purity of the copper which would conventionally lower the electrical conductivity. As can be appreciated, conventional copper has a conductivity of about 100% IACS with ultrapure copper rising to an IACS of about 101% and copper alloys having an IACS of less than 100% IACS.

However, it has been difficult in practice to produce commercial quantities of ultra-conductive metals to serve in certain applications, such as conductive elements of electrical wires. Instead, most known ultra-conductive wires have either exhibited lower conductivity and/or have been producible only in limited quantities. It has been presently discovered that the conductivity of an ultra-conductive wire can be improved through appropriate processing of the ultra-conductive metal. Advantageously, the improvements to the ultra-conductive wires described herein can require only trace quantities of nano-carbon in the ultra-conductive metal limiting the time and difficulty required to produce the ultra-conductive wire.

Specifically, it has been unexpectedly discovered that ultra-conductive metals can be processed to enhance electrical conductivity through the successive steps of cold wire drawing and annealing. Collectively, these steps can improve the conductivity of the ultra-conductive metal when forming an ultra-conductive wire without requiring exotic processing and without requiring the ultra-conductive metal to incorporate commercially untenable quantities of the nano-carbon additive.

It is believed that cold wire drawing can improve the alignment of the nano-carbon additives in the ultra-conductive metal and that annealing can improve the metal's crystalline structure. As can be appreciated, nano-carbon additives are highly anisotropic conductors meaning that they have a higher ampacity when aligned in-plane than out of plane. Cold wire drawing can elongate the ultra-conductive metal and can align the nano-carbon additives longitudinally along the length of a pre-wire product. Annealing of the pre-wire product can then enhance the electrical conductivity of the resulting ultra-conductive wire by recrystallizing the pure metal and repairing any detriments caused by the cold wire drawing process.

The electrical conductivity of an ultra-conductive wire that has been subject to cold wire drawing and annealing according to the methods described herein can exhibit an about 0.5%, or greater, increase in IACS conductivity, an about 0.75%, or greater, increase in IACS conductivity, an about 1.00%, or greater, increase in IACS conductivity, an about 1.25%, or greater, increase in IACS conductivity, or an about 1.50%, or greater, increase in IACS conductivity. The improvement to IACS conductivity for such ultra-conductive wire can be greater than the additive improvements to IACS conductivity of other wires that are subjected to only one of cold wire drawing or annealing.

Generally, the steps of cold wire drawing and annealing can be performed as known in the art. For example, cold wire drawing can be performed at room temperature by pulling a pre-wire product formed from an ultra-conductive metal through a die, or a series of sequential dies, to reduce the circumferential area of the pre-wire product. In certain embodiments, suitable cold wire drawing steps can reduce the total area of a pre-wire product by about 30% or greater, about 35% or greater, about 40% or greater, about 45% or greater, or about 50% or greater. As can be appreciated, greater area reductions can result in greater alignment of the highly conductive additives in the metal phase.

Likewise, annealing can be performed by heating the drawing wire to a temperature above the recrystallization temperature of the pure metal in the ultra-conductive metal, maintaining the temperature for a period of time, and then cooling the pure metal. For example, when the ultra-conductive metal is ultra-conductive copper, annealing can be performed at temperatures of about 300° C. to about 700° C. and can be held at such temperatures for about 1 hour to about 5 hours. Cooling can be performed by allowing the heat treated pure metal to cool over time or through quenching.

Beneficially, the cold wire drawing process and annealing process described herein can be suitable for use with any materials formed from ultra-conductive metals which incorporate nano-carbon additives. In certain embodiments, the ultra-conductive metals can be ultra-conductive copper. As can be appreciated, ultra-conductive copper can readily replace traditional copper applications which already require high electrical conductivity and which would benefit from even greater electrical conductivity. For example, ultra-conductive copper can be useful to form the conductive elements of wire/cable, electrical interconnects, and any components formed thereof such as cable transmission line accessories, integrated circuits, and the like. Replacement of copper in such applications can allow for immediate improvement without requiring redesign of the systems. For example, power transmission lines formed from the improved ultra-conductive coppers described herein can transmit a greater amount of power (ampacity) than a similar power transmission line formed from traditional copper.

Generally, suitable ultra-conductive metals can be made through any known process which incorporates nano-carbon additives into a pure metal. As used herein, a pure metal means a metal having a high purity such as about 99% or greater purity, about 99.5% or greater purity, about 99.9% or greater purity, or about 99.99% or greater purity. As can be appreciated, purity can alternatively be measured using alterative notation systems. For example, in certain embodiments, suitable metals can be 4N or 5N pure which refer to metals having 99.99% and 99.999% purity respectively. As used herein, purity can refer to either absolute purity or metal basis purity in certain embodiments. Metal basis purity ignores non-metal elements when assessing purity. As can be appreciated, any impurities other than the desired nano-carbon additives will lower the electrical conductivity of the ultra-conductive metal.

Known methods of forming suitable ultra-conductive metals for the methods and improvements described herein can include deformation processes, vapor phase processes, solidification processes, and composite assembly from powder metallurgy processes. In certain embodiments, deposition methods can advantageously be used to form the ultra-conductive metals as such processes form large quantities of the ultra-conductive metals and can form such ultra-conductive metals with suitable quantities of nano-carbon additives. Generally, the deposition methods described herein can deposit nano-carbon onto metal pieces which are then processed together to form a larger mass of ultra-conductive metal.

As can be appreciated, the deposition method described herein can be modified in a variety of ways. For example, the initial metal pieces can be metal plates, sheets, or cross-sectional slices of rods, bars, and the like. Generally, such metal pieces can be prepared from a high purity metal and then cleaned to remove contaminants as well as any oxidation. For example, submersion in acetic acid can remove oxidation damage to copper which would otherwise lower the electrical conductivity of the resulting ultra-conductive copper.

In certain embodiments of the disclosed deposition methods, graphene can be directly deposited on the surfaces of metal pieces using a chemical vapor deposition ("CVD") process. In such embodiments, the metal pieces can be placed in a heated vacuum chamber and then a suitable graphene precursor gas, such as methane, can be pumped in. Decomposition of the methane can form graphene. As can be appreciated however, other deposition process can alternatively be used. For example, other known chemical vapor deposition processes can be used to deposit graphene or other nano-carbon additives such as carbon nanotubes. Alternatively, other deposition processes can be used. For example, nano-carbon particles can alternatively be deposited from a suspension of the nano-carbon additive in a solvent.

Additional details about exemplary methods of forming ultra-conductive metals which can be improved by the methods described herein are disclosed in PCT Patent Publication No. WO 2018/064137 which is hereby incorporated herein by reference. As can be appreciated, ultra-conductive metals can alternatively be obtained in manufactured form. In such embodiments, the cold wire drawing and annealing processes described herein can improve the electrical conductivity.

In certain embodiments, the ultra-conductive metals can include any known nano-carbon additives. For example, in certain embodiments, the nano-carbon additives can be carbon nanotubes or graphene. The highly conductive additives can be included in the metal in any suitable quantity including about 0.0005%, by weight, or greater, about 0.0010%, by weight, or greater, about 0.0015%, by weight, or greater, or about 0.0020%, by weight or greater. As will be appreciated, the processes described herein can improve the electrical conductivity of the ultra-conductive metal reducing the need to incorporate high loading levels (e.g., 10% or greater) of the nano-carbon additive.

EXAMPLES

An ultra-conductive copper wire was produced to evaluate the conductivity improvements of the cold wire drawing and annealing processes described herein. The ultra-conductive copper wire was formed using a deposition process followed by extrusion. Specifically, the ultra-conductive copper wire was formed by depositing graphene on cross-sectional slices of a 0.625 inch diameter copper rod formed of 99.99% purity copper (UNS 10100 copper). The cross-sectional slices, or discs, had a thickness of 0.00070 inches. The cross-sectional slices were cleaned in an acetic acid bath for 1 minute.

Graphene was deposited on the cross-sectional slices using a chemical vapor deposition ("CVD") process. For the CVD process, the cross-sectional slices were placed in a vacuum chamber having a vacuum pressure of 50 mTorr, or less, and then purged with hydrogen for 15 minutes at 100 $cm^3$/min to purge any remaining oxygen. The vacuum chamber was then heated to a temperature of 900° C. to 1,100° C. over a period of 16 to 25 minutes. The temperature was then held a further 15 minutes to ensure that the cross-sectional slices reached equilibrium temperature. Methane and inert carrier gases were then introduced at a rate of 0.1 L/min for 5 to 10 minutes to deposit graphene on the surfaces of the cross-sectional slices.

Multiple graphene covered cross-sectional slices were formed into a wire by stacking the graphene covered cross-sectional slices and wrapping them in copper foil. The wrapped stack was then extruded at 700° C. to 800° C. in an inert nitrogen atmosphere using a pressure of 29,000 psi over about 30 minutes. The extruded wire had a diameter of 0.808 inches and was 0.000715%, by weight, graphene.

Table 1 depicts the electrical properties of the ultra-conductive copper wire as processed using the methods described herein. Example 1 is a wire as extruded formed of an ultra-conductive metal. Example 2 was formed by cold wire drawing the wire of Example 1 to a diameter of 0.0670 inches. Example 3 is the wire of Example 2 after annealing at 430° C. for 2 hours. Example 4 is the wire of Example 1 after annealing at 430° C. for 2 hours. Example 4 was not cold wire drawn. IACS conductivity was measured at 20° C.

TABLE 1

| | Condition | Diameter (Inches) | Conductivity (% IACS) |
|---|---|---|---|
| Example 1 | As extruded | 0.0808" | 99.6% |
| Example 2 | Cold wire drawn | 0.0670" | 99.3% |
| Example 3 | Cold wire drawn + annealed at 430° C. for 2 hours | 0.0670" | 100.5% |
| Example 4 | Annealed at 430° C. for 2 hours | 0.0808" | 99.8% |

As depicted in Table 1, the wire for Example 3 exhibits an IACS conductivity of 100.5% while each of the wires for Examples 1, 2 and 4 each exhibit an IACS conductivity of less than 100%. Neither the step of cold wire drawing or annealing alone significantly increased electrical conductivity of the extruded wire, unlike the dual processing of Exhibit 3 which greatly enhanced the conductivity of the wire.

It should be understood that every maximum numerical limitation given throughout this specification includes every lower numerical limitation, as if such lower numerical limitations were expressly written herein. Every minimum numerical limitation given throughout this specification will include every higher numerical limitation, as if such higher numerical limitations were expressly written herein. Every numerical range given throughout this specification will include every narrower numerical range that falls within such broader numerical range, as if such narrower numerical ranges were all expressly written herein.

Every document cited herein, including any cross-referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests, or discloses any such invention. Further, to the extent that any meaning or definition of a term in this document conflicts with any meaning or definition of the same term in a document incorporated by reference, the meaning or definition assigned to that term in the document shall govern.

The foregoing description of embodiments and examples has been presented for purposes of description. It is not intended to be exhaustive or limiting to the forms described. Numerous modifications are possible in light of the above teachings. Some of those modifications have been discussed and others will be understood by those skilled in the art. The embodiments were chosen and described for illustration of ordinary skill in the art. Rather it is hereby intended the scope be defined by the claims appended various embodiments. The scope is, of course, not limited to the examples or embodiments set forth herein, but can be employed in any number of applications and equivalent articles by those of hereto.

What is claimed is:

1. A method of making an ultra-conductive wire having enhanced conductivity, the method comprising:

cold wire drawing a pre-wire product formed form an ultra-conductive metal to form a drawn wire, wherein the ultra-conductive metal is formed from a pure metal and a nano-carbon additive, wherein the pure metal is copper, and wherein the ultra-conductive wire comprises about 0.0005%, by weight, to about 0.1%, by weight, of the nano-carbon additive; and annealing the drawn wire to form an ultra-conductive wire; and wherein the ultra-conductive wire exhibits an International Annealed Copper Standard ("IACS") conductivity of 100% or greater.

2. The method of claim 1, wherein the step of cold wire drawing reduces the cross-sectional area of the pre-wire product by about 25% or more.

3. The method of claim 1, wherein the nano-carbon additive comprises a carbon nanotube, graphene, or a combination thereof.

4. The method of claim 1, wherein the copper comprises an absolute purity of about 99.99% or greater.

5. The method of claim 1, wherein the ultra-conductive wire exhibits an International Annealed Copper Standard ("IACS") conductivity of about 100.5% or greater.

6. The method of claim 1, wherein the ultra-conductive wire has a diameter of about 0.01 inches to about 0.2 inches.

7. The method of claim 1, wherein the ultra-conductive metal is formed from a deposition process, a deformation process, a vapor phase process, a solidification process, or a powder metallurgy process.

8. A cable comprising:

one or more conductive elements each comprising an ultra-conductive wire obtained according to the method of claim 1; and one or more cable covering layers surrounding the one or more conductive elements.

9. The method of claim 1, wherein the step of annealing comprises heating the drawn wire to a temperature of about 300° C. to about 700° C. for about 2 hours or more.

10. The method of claim 1, wherein the ultra-conductive metal is formed from a chemical vapor deposition process.

11. The method of claim 10, wherein the pre-wire product is formed by stacking a plurality of ultra-conductive metal pieces formed from the chemical vapor deposition process.

* * * * *